United States Patent [19]

Jabalee

[11] Patent Number: 4,810,406

[45] Date of Patent: Mar. 7, 1989

[54] FLUSH-FREE COOLING SYSTEM TREATMENT COMPOSITION

[75] Inventor: Gerald Jabalee, Sunrise, Fla.

[73] Assignee: Cosmos Chemical, Inc., Dania, Fla.

[21] Appl. No.: 169,320

[22] Filed: Mar. 17, 1988

[51] Int. Cl.[4] ..... C11D 7/08

[52] U.S. Cl. ..... 252/87; 252/75; 252/78.3; 252/80

[58] Field of Search ..... 252/75, 78.3, 80, 87

[56] References Cited

U.S. PATENT DOCUMENTS

| | | | |
|---|---|---|---|
| 3,198,820 | 8/1965 | Pines et al. | 252/78.3 |
| 4,402,847 | 9/1983 | Wilson et al. | 252/75 |
| 4,452,715 | 6/1984 | Hirozawa | 252/75 |

*Primary Examiner*—Robert A. Wax

*Attorney, Agent, or Firm*—Herbert L. Lerner; Laurence A. Greenberg

[57] ABSTRACT

A flush-free cooling system treatment composition includes substantially 1 part silicone silicate, substantially 2.9 parts phosphoric acid, and substantially 28.1 parts water.

4 Claims, No Drawings

FLUSH-FREE COOLING SYSTEM TREATMENT COMPOSITION

The invention relates to a cooling system treatment composition for dissolving rust, calcium and lime in an automobile cooling system, in order to avoid radiator and cooling system failure, without requiring the cooling system to be flushed.

U.S. Pat. No. 1,917,489 discloses a method for removing deposits from automobile radiators and the like. According to that method, a solvent such as trichlorethylene is first added to the vessel, followed by a salt which attacks rust. A water soluble salt is then added to cause the solvent to rise. Water is then added and the solution is drained, in other words, flushing is performed.

U.S. Pat. No. 2,326,837 relates to a method of cleaning scale, rust, oil and grease from metal surfaces of automobile radiators. A dry or solid mixture is formed of an acidic agent, an organic compound acting as an emulsifying agent and an agent inhibiting the attack of the acid agent on sensitive portions of the radiator. The active cleaning agent which is preferred is sodium bisulfate although mono-sodium acid phosphate and oxalic and citric acids may be used. The emulsifying agent is preferably chosen from sulfonates and sulfate esters. The inhibiting agent may be a water-soluble phosphate such as ammonium and alkali metal phosphates. The cleaning composition is dissolved in water or alcohol and circulated through the cooling system. The system is then flushed and refilled with clean hot water once or twice.

U.S. Pat. No. 4,720,306 discloses a method for cleaning vessels in which deposits are dissolved chemically and removed mechanically. Any remaining encrustations are softened chemically and flushed out of the vessel.

In U.S. Pat. No. 3,794,523, an aromatic solvent in aqueous acid solution emulsion is used to clean surfaces which are covered with an organic deposit.

According to U.S. Pat. No. 3,969,255, a pipe or vessel cleaning composition is proposed which contains hydrochloric acid, furfural, dialkylthiourea, benzyl thiocyanate and water.

Finally, the inventor of the invention of the instant application extensively tested a composition for cleaning radiators which was to be left in the cooling system without flushing. A 32 oz. quart of the composition contained between 3.5 and 5.0 oz. phosphoric acid, 1 oz. silicone silicate and the balance water and food grade coloring. However, it was discovered that this composition was unsuitable for the cooling system of four-cylinder engines.

It is thus seen that the three compositions mentioned first all deal with cleaning vessels such as automobile radiators, but all require flushing. The two compositions mentioned next do not deal with automobile radiators and it must be assumed that flushing would be necessary to remove the compositions from a cooling system of an automobile, if they were even found to be suitable for such an application. The last composition apparently also would require flushing at least in smaller engines.

The flushing of radiators is a time-consuming and difficult and expensive procedure to follow. Naturally, it must be done out of doors since the engine must be allowed to run, and if the radiator is particularly clogged with deposits, flushing must be repeated several times. Therefore, it is especially troublesome for the automobile owner to carry out the cooling system cleaning on his own. Furthermore, all of the antifreeze in the cooling system is lost and must be replaced when flushing is carried out.

However, prior art compositions have been made so strong in order to remove as much of the deposits as possible, that they cannot be permitted to remain in the cooling system after cleaning and must be flushed.

It is accordingly an object of the invention to provide a flush-free cooling system treatment composition, which overcomes the hereinafore-mentioned disadvantages of the heretofore-known compositions of this general type and which is gentle enough to make flushing unnecessary, while being strong enough to remove deposits from the radiator.

With the foregoing and other objects in view there is provided, in accordance with the invention, a flush-free cooling system treatment composition, comprising substantially 1 part silicone silicate, substantially 2.9 parts phosphoric acid, and substantially 28.1 parts water.

In accordance with another feature of the invention, there is provided coloring added to the silicone silicate, phosphoric acid, and water.

In accordance with a further feature of the invention, the phosphoric acid is food grade phosphoric acid.

In accordance with a concomitant feature of the invention, the coloring is food coloring.

Other features which are considered as characteristic for the invention are set forth in the appended claims.

Although the invention is illustrated and described herein as embodied in a flush-free cooling system treatment composition, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments.

The composition according to the invention is simply produced by mixing two active ingredients in water. For a 32 oz. quantity of the composition, approximately one oz. of silicone silicate is used. Depending on the size of the engine to be treated, between approximately 2.5 and 5.0 oz. of food grade phosphoric acid is used, with the balance being water. However, as mentioned above, no more than approximately 2.9 oz. of food grade phosphoric acid may be used per quart for four-cylinder engines in order to avoid adverse circulation. Industrial grade phosphoric acid was found to be detrimental for aesthetic reasons relating to coloring. A third ingredient is a coloring, such as food grade blue coloring.

In order to use the composition in a cooling system, the system must be able to receive one quart of the composition, such as by removing one quart of liquid already in the system if the system is full. One quart of the composition is then added to the cooling system and the automobile is driven in the normal manner.

The composition cleans the cooling system, including the radiator, engine block and heater core by removing rust, calcium and lime deposits. No flushing of the cooling system is required and therefore no replacement of antifreeze is necessary.

The composition was tested in a variety of different motor vehicles over a period of several months and no adverse effects attributable to the composition could be found. Cooling systems of automobiles, sports cars and trucks of foreign and domestic manufacture were tested. Both old and new vehicles were part of the tests. Various police vehicles were also tested because of their heavy usage.

I claim:

1. Flush-free cooling system treatment composition, consisting essentially of approximately 1 part silicone silicate, approximately 2.9. parts phosphoric acid, and approximately 28.1 parts water.

2. Flush-free cooling system treatment composition according to claim 1, including coloring added to the silicone silicate, phosphoric acid, and water.

3. Flush-free cooling system treatment composition according to claim 2, wherein said coloring is food grade coloring.

4. Flush-free cooling system treatment composition according to claim 1, wherein said phosphoric acid is food grade phosphoric acid.

* * * * *